US006098470A

United States Patent [19]

Donahue et al.

[11] Patent Number: 6,098,470

[45] Date of Patent: Aug. 8, 2000

[54] METHOD AND APPARATUS FOR TESTING HOOK RELEASE

[75] Inventors: Thomas M. Donahue, Houston; Robert J. Kahak, Humble, both of Tex.; Mark W. Dunlap, Marrow, La.; Peter W. Nimmo, Houston, Tex.

[73] Assignee: Alexander/Ryan Marine & Safety Co., Houston, Tex.

[21] Appl. No.: 09/189,573

[22] Filed: Nov. 11, 1998

[51] Int. Cl.[7] ..... G01L 5/00

[52] U.S. Cl. ..... 73/862.56; 73/831

[58] Field of Search ..... 73/827, 828, 831, 73/865.9, 862.56; 114/378; 294/82.27

[56] References Cited

U.S. PATENT DOCUMENTS

| | | | |
|---|---|---|---|
| 3,827,514 | 8/1974 | Bradley | 177/147 |
| 3,938,381 | 2/1976 | Rundell et al. | 73/143 |
| 4,112,750 | 9/1978 | Murakami | 73/862.56 |
| 4,228,681 | 10/1980 | Purex | 73/862 |
| 4,587,922 | 5/1986 | Olestad . | |
| 4,610,474 | 9/1986 | Jaatinen . | |
| 4,763,943 | 8/1988 | Melvin . | |
| 5,078,073 | 1/1992 | Betz et al. . | |
| 5,102,176 | 4/1992 | Duggal . | |
| 5,292,165 | 3/1994 | Wiklund . | |
| 5,501,108 | 3/1996 | Kuiken | 73/862.57 |
| 5,619,951 | 4/1997 | Constantinis . | |
| 5,831,173 | 11/1998 | Hanano | 73/831 |

*Primary Examiner*—Max Noori
*Attorney, Agent, or Firm*—Baker Botts L.L.P.

[57] ABSTRACT

Apparatus and method are provided for testing the release hook mechanism used to release an emergency survival craft from its davit. The test is performed with a selected load applied to the hook mechanism, and is designed to satisfy regulations for no-load and on-load testing of release mechanisms.

10 Claims, 3 Drawing Sheets

METHOD AND APPARATUS FOR TESTING HOOK RELEASE

1. FIELD OF THE INVENTION

This invention relates generally to release mechanisms for supporting a survival craft such as a lifeboat or capsule from a ship or structure. More specifically, method and apparatus for testing the hook mechanism attached to and supporting the survival craft in the stored position is provided.

2. BACKGROUND OF THE INVENTION

Ships and offshore structures are supplied with lifeboats, capsules or other survival craft that can be used in an emergency to evacuate personnel from the vessel or structure. Such craft must be quickly accessible for use in case of an emergency. The craft have one or more release hooks used to support the craft from a davit. The davit includes cables and a winch mechanism that may be used to lower the craft to the water surface and raise the craft from the water. The release hook mechanism on the craft is normally operated when the craft is on the surface of the water. Since the release hook mechanisms are used infrequently, testing them periodically to determine that the release hooks are in operable condition is necessary. To insure operability, regulations require those release hook mechanisms be tested under no load and under an overload condition. It is current practice to simulate or launch the survival craft to determine that the release mechanism is operable under no load. To test under a load, it is current practice to place a load in the survival craft, lower the survival craft to a position just above the water surface and then operate the hook release mechanism on the craft.

A variety of models of davits and release hook mechanisms are approved for supporting the emergency craft. One hook is required on capsules, rescue boats and similar vessels and two hooks, which must release simultaneously, are required on lifeboats. The release lever mechanism for releasing the hooks is normally found inside the craft.

Regulations of the U.S. Coast Guard/Solas/IMO require that the release mechanism be tested once every five years. These regulations apply to U.S. and foreign flag vessels operating anywhere in the world. Many other countries also require that the support and release hook mechanism of the survival craft on their flag state vessels or structures in their territorial waters be periodically tested for operability. Resolution MSC 66/24 of the International Maritime Organization (IMO) requires that the release mechanism shall have two release capabilities: a normal release capability that will release a survival craft when it is waterborne (no load on the hooks) and an on-load release capability that will release the lifeboat with a load on the hooks. The on-load release capability should be demonstrated under any condition of loading from no load to a load of 1.1 (110%) times the total mass of the lifeboat when loaded with its full complement of persons and equipment.

There is need for a method and apparatus for testing the release hooks on capsules and similar vessels under a load required by regulations without launching the survival craft from the davit. Such a method and apparatus should make possible safer, less expensive testing and testing, if needed, more frequently. This will contribute to the safety and protection of life and property in sea operations.

SUMMARY OF THE INVENTION

Apparatus is provided for performing tests of release hook mechanisms on survival craft, capsules or other vessels. The apparatus includes a means for applying force, such as a hydraulic cylinder, and means for measuring the force applied.

A method is provided for placing a rigid test structure between a davit and the release hook mechanism support of a survival craft, capsule or other vessel such that a selected load can be applied to the hook while the release hook mechanism is released without launching the survival craft from its davit to the water. A hydraulic cylinder may apply the load and a load cell can measure the load. The test structure apparatus may be attached to the davit and to the release hook mechanism on the survival craft, capsule or other vessel by two padeyes that are normally used to attach the maintenance pendants or other attachment points.

BRIEF DESCRIPTION OF THE DRAWINGS

FIG. 1(*b*) shows the front end view of the lifeboat and davit.

DETAILED DESCRIPTION OF THE INVENTION

Figure 1A:
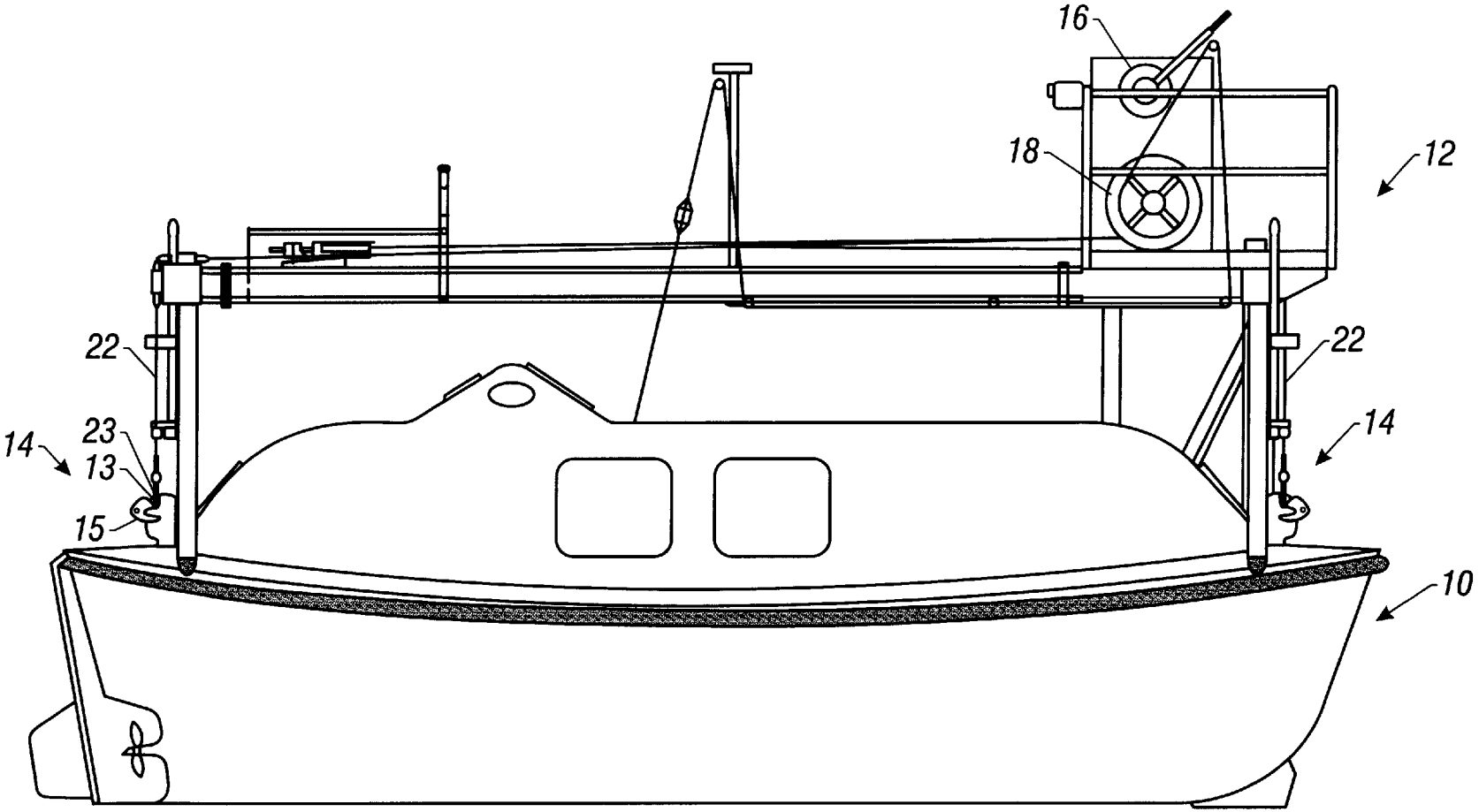
FIG. 1(*a*) shows the side view of a lifeboat supported in a davit.
Figure 1B:
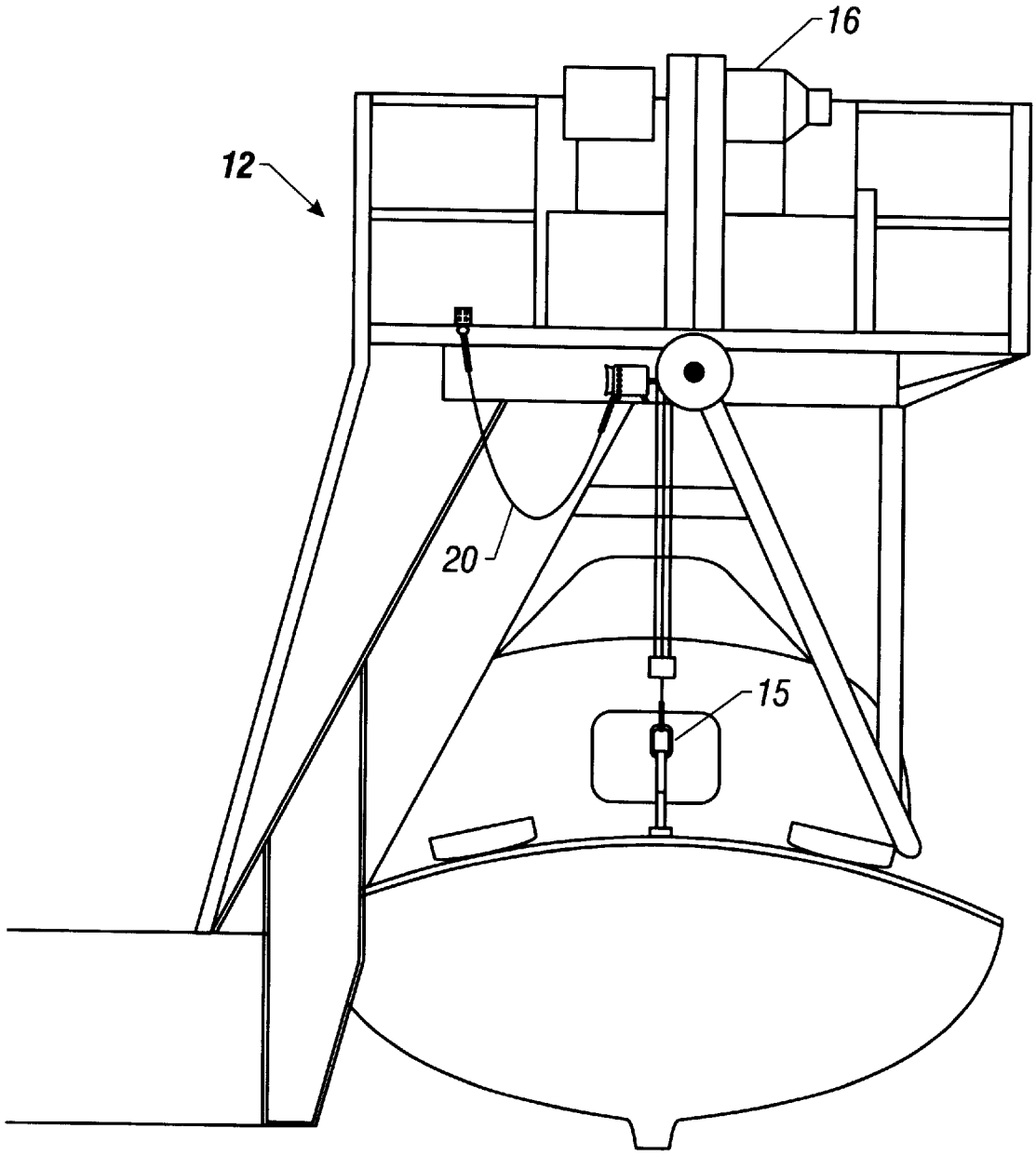

Referring to FIG. 1(*a*), lifeboat 10 is shown supported by davit 12. Support of the boat is through release hook assembly 14 on each end of the boat. The boat may be lowered or raised using winch 16, drum 18 and other mechanisms well known in the art of davit systems. Release hook assembly 14 is attached to the hull of boat 10 to support the boat under all working loads and includes hook release 13 and padeye 15. Such release hook mechanisms are available, for example, under the names VIKING, ROTTMER, TITAN, TOR and BG-7. Other release hook mechanisms are known in the art. The sizes and designs of the release hook assemblies may vary.

FIG. 1(*b*) shows the front end view of boat 10 and davit 12 of FIG. 1(*a*). Maintenance pendant 20 is attached to davit 12 by the upper end of pendant 20. The lower end of pendant 20, shown in its stored position hooked to the platform of davit 12, may be released and lowered to attach it to padeye 15 in release hook assembly 14. Pendant 20 may be used as a backup support for boat 10 when personnel enter boat 10 in its stored position to insure that boat 10 will not drop to the water in the event cable 22 of davit system 12 is inadvertently released from hook 13. Hook 13, sometimes called a "release gear hook," operates directly on ring 23, which may be a D-ring or other form of a ring, which is attached to cable 22. Hook 13 is normally actuated remotely from the console of boat 10 such that ring 23 is released from the hook, thereby releasing boat 10 from davit 12.

Figure 2:
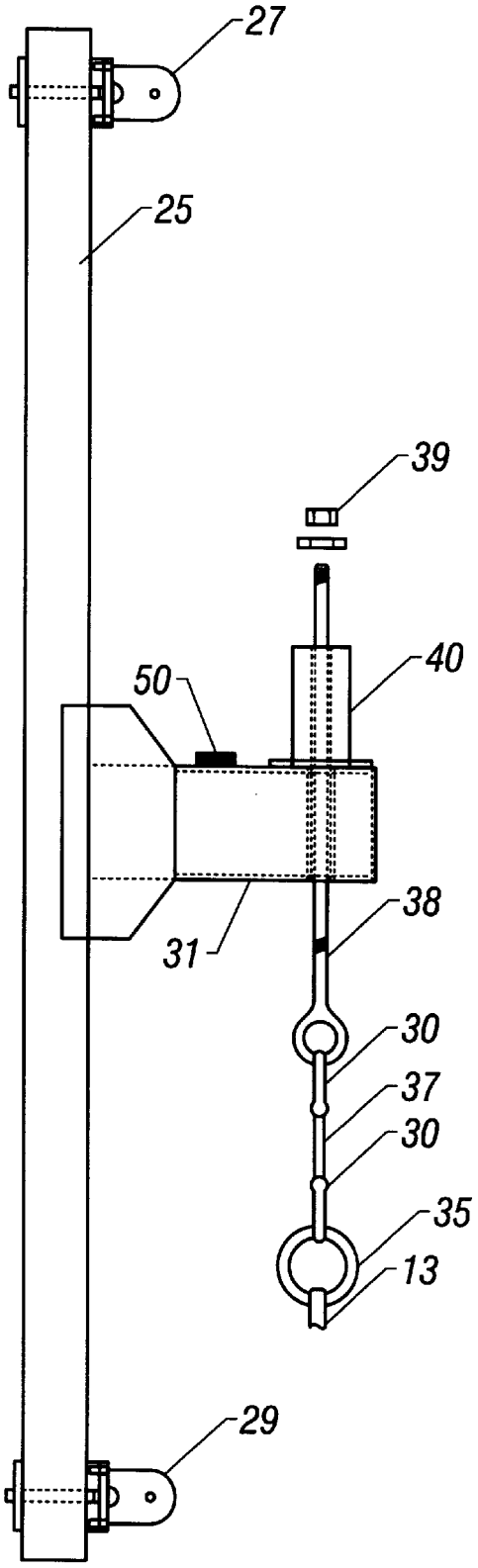
FIG. 2 shows a drawing of one embodiment of the apparatus of this invention.

One embodiment of the apparatus of this invention, which can be used to place a selected load on hook 13 to insure that the hook can be remotely actuated in the presence of a load, is shown in FIG. 2. Beam 25 provides for rigid attachment of a lifeboat or other vessel to a davit during the testing method provided by this invention. Beam 25 has upper padeye 27 and lower padeye 29 rigidly attached to the beam. Padeyes may be attached by a bar or bolts extending through beam 25 such that alternate padeyes may be used or other removable mechanisms may attach padeyes or they may be permanently attached. For example, a single padeye or a clevis padeye may be attached to beam 25, the padeyes being adapted to the padeyes on the davit and release hook assembly where a test is to be performed. Lateral member 31 is attached to beam 25 such that it has sufficient strength to apply the test load of the inventive apparatus. Lateral member 31 may be attached by welding. Release gear hook 13 is a part of release hook assembly 14, shown in FIG. 1(*a*). Round link or D-ring 35 is adapted to and sized to engage hook 13 of the release hook assembly on the boat to be tested. Ring 35 can be connected by shackles 30 or other means known in the art to load cell 37, which is suitable for measuring loads applied. Dynalink Company supplies a suitable load cell. Model MSI 7200 fitted with two shackles may be used. Load bearing rod 38, having an eye at one end, is attached to load cell 37 by shackle 30 or other means. Rod 38 extends through lateral member 31 and hydraulic cylinder 40 and may be threaded to be held in place by hex nut 39. Hydraulic cylinder 40 is preferably adapted for center-hole loading, but other arrangements for applying applied loads to rod 38 may be used. A hand-operated hydraulic pump may power hydraulic cylinder 40 to extend the cylinder and place tensile loading on rod 38. A single-acting center-hole hydraulic cylinder available from Power Team Co., Mod. RH-203, having a 20-ton capacity, is suitable for some applications. Alternatively, the applied load may be applied by a screw mechanism, a pneumatic cylinder or other means commonly known in industry, which is used in place of hydraulic cylinder 40.

In another embodiment of the apparatus of this invention, load cell 37 may be replaced by strain gauge 50 (FIG. 2). Strain gauge 50 serves the same purpose as load cell 37, measuring the tensile force applied to ring 35 in hook 13.

The method for testing a release hook mechanism according to this invention is as follows, referring to FIG. 1 and FIG. 2: [1] check that release hooks 13 are closed and that winch 16 on davit 12 is working; [2] detach and remove maintenance pendants 20 from davit 12; [3] for each hook that is to be tested, attach upper padeye 27 of the test apparatus to davit 12 in place of the maintenance pendant; [4] slowly lower boat 10 using winch 16 until lower padeye 29 on the test apparatus can be attached to maintenance lug 15 of release hook assembly 14 and attach the padeye; [5] lower the boat until the weight is completely transferred from launch cables 22 to beam 25 of the test apparatus; [6] release the brake on the winch and payout additional cable and detach launch cables 22 from boat 10; [7] attach ring 35 to hook 13 of the release hook assembly and rig up the test fixture to apply and measure loads using hydraulic cylinder 40 and test cell 37; zero out test cell 37; [6] pump hydraulic cylinder 40 to apply a selected load to the hook mechanism, which may be equal to 1.1 times (110% of) the maximum working load of the boat; and [7] one person enter the boat and remotely actuate the hook on the boat and observe whether the hook releases. The test is now complete. After the test, ensure that the release gears closed then reset the release gear and install the safety pin, remove the hydraulic cylinder, load cell and test ring from the test apparatus, and reinstall the launch cables back in the release hook 13 and raise the boat to remove lower padeye 29 from release assembly 14. Then raise boat 10 back to its fully stored position and remove upper padeye 27 of the test apparatus from davit 12. Then reattach maintenance pendant 20 to davit 12.

A suitable material for the beams of the test apparatus is ASTM A-500 Gr. B steel or equivalent. Welding should be in accord with American Bureau of Shipping requirements.

Although the present invention has been described with reference to specific details, it is not intended that such details should be regarded as limitations upon the scope of the invention, except as and to the extent that they are included in the accompanying claims.

What we claim is:

1. Apparatus for testing a release hook assembly on a survival craft, comprising:

a support beam having a top end and a bottom end with a lateral beam attached therebetween;

means for attaching the top end of the support beam to a davit and the bottom end of the support beam to the release hook assembly, the release hook assembly having a release hook; and a test ring, a means for measuring force and a means for applying load force to the test ring, the test ring being adapted to be placed in the release hook and the means for measuring force being positioned so as to measure the load force applied by the means for applying force, the means for applying force being supported by the lateral beam.

2. The apparatus of claim 1 wherein the means for attaching the top end of the support beam to the davit and the bottom end of the support beam to the release hook assembly is a padeye.

3. The apparatus of claim 1 wherein the means for measuring force is a load cell.

4. The apparatus of claim 1 wherein the means for applying load force is a hydraulic cylinder.

5. The hydraulic cylinder of claim 4 wherein the hydraulic cylinder is adapted for center-hole loading.

6. A method for testing a release hook assembly on a survival craft, comprising:

attaching a rigid beam between a davit supporting the survival craft and the release hook assembly, the assembly having a release hook;

engaging a test ring with the release hook, the test ring being attached to a load-measuring device and a source of load;

applying and measuring a selected load to the test ring engaged with the release hook; and remotely activating the release hook and observing its operability.

7. The method of claim 6 wherein the source of load is a hydraulic cylinder.

8. The method of claim 6 wherein the source of load is a screw mechanism.

9. The method of claim 6 wherein the load-measuring device is a load cell.

10. The method of claim 6 wherein the load-measuring device is a strain gage.

* * * * *